United States Patent [19]

Quijano C.

[11] Patent Number: 4,569,524

[45] Date of Patent: Feb. 11, 1986

[54] GOLF CLUBS

[76] Inventor: Miguel Quijano C., Tezoquipa No. 127, México 22, D. F., Mexico

[21] Appl. No.: 629,849

[22] Filed: Jul. 11, 1984

[30] Foreign Application Priority Data

Jul. 14, 1983 [MX] Mexico ..... 198022

[51] Int. Cl.[4] ..... A63B 53/04

[52] U.S. Cl. ..... 273/173; 273/164

[58] Field of Search ..... 273/173, 167 J, 164, 273/163 R, 183 D, 174

[56] References Cited

U.S. PATENT DOCUMENTS 4,181,306 1/1980 Jepson ..... 273/173

FOREIGN PATENT DOCUMENTS 2248 of 1894 United Kingdom ..... 273/167 J

*Primary Examiner*—George J. Marlo

*Attorney, Agent, or Firm*—Roylance, Abrams, Berdo & Goodman

[57] ABSTRACT

A golf club including a head containing a solid pentagonal shaped insert embedded in the striking face. The insert includes two triangular faces, two rectangular faces and one rectangular base. The pentagonal shaped insert is located on a ledge in the front of the club head so that the triangular faces define upper and lower horizontal faces of the insert, and an apex of each triangular face is directed toward the rear of the club head. The insert is made of a hard material selected from a group including agate, onyx, rock crystal, turmaline, amethyst, aventurine, citrine, dumertierite, prasiolite, smoked quartz, rose quartz, tigers eye, zircon, axinite and calcedone.

13 Claims, 2 Drawing Figures

GOLF CLUBS

BACKGROUND OF THE INVENTION

Golf is a sport of Saxon origin, which has been played for several centuries in England and Scotland, but which has acquired great popularity in the whole world in recent times. It is played on a very ample terrain called "link", usually with a run of some 7 Km. The link is usually comprised of 9 to 18 holes, each hole being of a distance of from 100 to 500 meters.

The game consists in making a hard rubber ball pass through each one of the holes with the help of some poles in the form of long sticks with points (heads) of steel or wood, called clubs in English; the ball must be launched until made to enter into the holes with the least possible number of blows.

The clubs which are used at present are made of very diverse materials, natural and synthetic, as not only wood and steel are used, but also plastic materials and different alloys. In all cases, the important thing is to always achieve the desired effect on the ball, in accordance with the intensity of the blow.

In the area called the "Green", which has very fine grass, a club called a PUTTER is used. The stroke employed with a putter is smooth and precise, for which reason it is necessary to use an adequate club which provides a touch which impels the ball rapidly and precisely on distances of, for example, up to 20 meters. The clubs used until now have the disadvantage of not having the necessary properties of hardness, elasticity and vibration. Because of this, golf players frequently fail because, if they give a very smooth touch, the ball almost does not advance, and if they make it very strong, it goes past the point where the hole is.

The present invention definitively resolves this problem, since the improved club for golf, which is the object of the same, achieves the precise, exact touch, which the skillful player will know how to capitalize on to his benefit.

OBJECTS OF THE INVENTION

The invention which is provided is an improved club for playing golf, which in a particular area of a lateral portion of the head presents an incrustation, preferably triangular, of a natural or synthetic semi-precious stone, with which the touch is given to the ball.

It is therefore one of the objectives of the present invention to provide an improved golf club for smooth, precise hits.

Another objective is that the improved club presents in incrustation of semi-precious stone on a lateral portion of the head thereof, with which the ball is hit in order to impel it.

Another objective is that the incrustation gives an impact to the ball, giving it additional energy which makes it roll better.

Still another objective is that the discovery be applied to different types and models of clubs, using an incrustation with a defined form, proportional in dimensions to the size of the club head.

The foregoing and other further objectives of the invention shall be established clearly and in detail in what follows.

DETAILED DESCRIPTION OF THE INVENTION

The embodiment of this invention illustrated in FIGS. 1 and 2, which is the object of the present patent description is described in detail in the following form: it includes a stick or pole which presents on the upper end a control handle and on the lower end a head in order to hit the ball, which head is characterized because in one particular area of the inside lateral area thereof, that is to say, what impels the ball, it has an incrustation or insert constituted by a solid pentagonal body with two lateral triangular faces, two rectangular faces, and one flat rectangular base, inserted in the head in such a way that the flat base thereof is on the same plane as the flat lateral area of the head. Thus, the mentioned body rests on the lower part of a hollow formed in said lateral portion of the head, the hollow having the same form as the solid body and forming an inferior or shelf portion on said head. This generally flat inferior portion is found at a particular distance which can be varied at will, from the lower face or base of the head.

Figure 1:
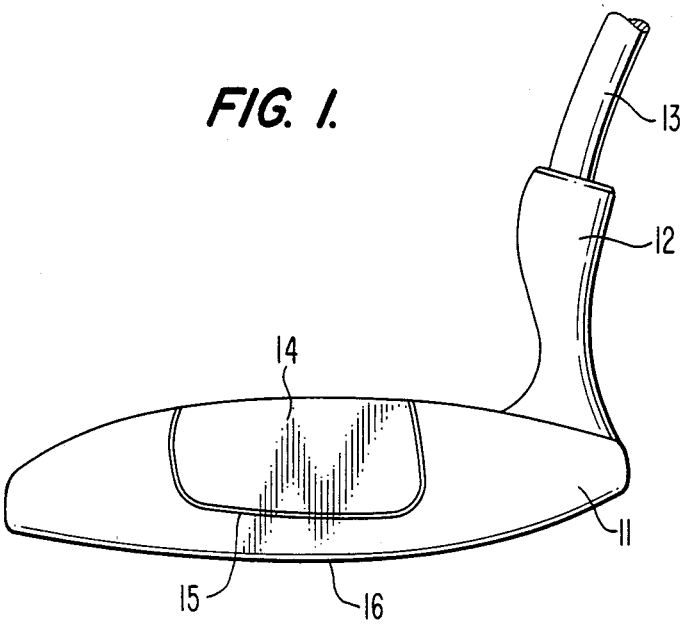
FIG. 1 is a front elevation view of one embodiment of this invention.

In reference to FIG. 1 which is a lateral view of the head of the gold club, the golf club includes head 11, the shaft 12 and the stick 13 on which the pole properly speaking (not illustrated) is firmly secured which, as has already been said, has a control sleeve or handle; the incrustation or insert 14 is observed, which rests on the inferior portion 15 of the hollow of the lateral portion of the head; this inferior portion 15 is found more or less close to the base 16 of the head.

Figure 2:
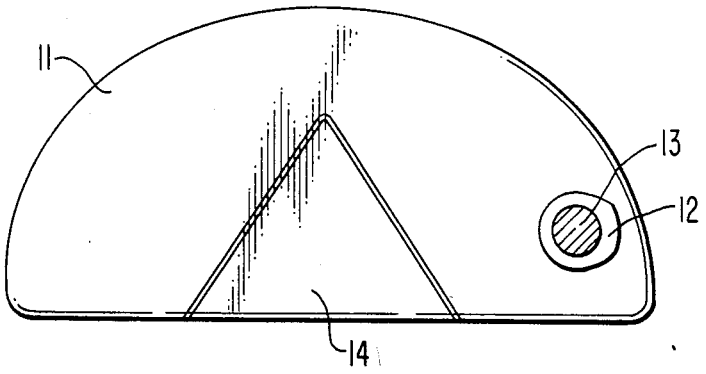
FIG. 2 is a top elevation view of the embodiment of this invention illustrated in FIG. 1.

FIG. 2 is a top view of the head of the club, wherein the structural parts 11, 12, 13 and 14 of FIG. 1 are illustrated.

Insert 14 can vary in form and dimensions, although the triangular form of two of the lateral faces thereof is preferred for two main reasons: 1st. The triangular design gives much more resistance to the insert, and 2nd, it serves as a sight in order to aim at the ball better and hit the ball with greater control over the blow and precision in the shot. Furthermore, on hitting the ball, greater handling of the club's center of gravity is achieved.

Although the dimensions and weight of the clubs are variable, the form of the insert is generally constant, although, of course, it may vary, for example in a square form, rectangular, half moon, elyptical form, etc.

In relation to the materials of which the insert is made, agates are preferred, but the following may also be employed: onyx, rock crystal, tourmaline, amethyst, aventurine, citrine, dumortierite, prasiolite, smoked quartz, rose quartz, tiger's eye, tircon, axinite, calcetone, chloromelanite, chrisoprase, demantoide, xilopale, jadeite, jaspe, kormerupine, peridote and tanzanite. In general, the hardness of all these semi-precious stones is found within the scale of 6.5–7 Mohr. The property is used which the same have of presenting constant vibrations since, for example, quartz is used in digital watches due precisely to this property.

In practice, it is seen that with the improved club which is provided, a firm, sure, precise hit on the ball is achieved, which gives the player great confidence in his game; the semi-precious stone used as an insert has the great advantage of the fact that it does not break with the impacts executed with this type of club.

The insert is united with the head of the club by means of an adequate, commercial type glue, for example, an epoxy glue, without there being limitations in this sense.

Likewise, said semi-precious stone insert is used, whatever the material of which the head is constructed, since the impact given the ball will always be with the flat exposed surface of the insert.

Although its use is preferred in the PUTTER, the possibility is not discarded of its being used in other clubs, possible with a metal protection or frame on the crystal of the lateral portion of the insert.

The invention has been described until here in accordance with the preferred embodiment thereof, it remaining established that whatsoever variation which has been taken as a basis, what was described and is claimed herebelow, necessarily falls within the scope of the same invention.

NOVELTY OF THE INVENTION

Having described the invention, it is considered as a novelty and that is claimed as property which is contained in the following:

I claim:

1. In a golf club having an enlarged head for striking a golf ball, said head having a surface designed to contact said ball when the club is properly employed, the improvement comprising:

a body of a size smaller than said head, said body being embedded in said head, said body being of a greater hardness than said head, said body including two substantially parallel triangular outer faces and three substantially rectangular outer faces connecting complementary edges of said triangular faces, one of said rectangular faces comprising a portion of said contacting surface of said head.

2. A golf club according to claim 1 wherein said body is a semi-precious stone.

3. A golf club according to claim 1 wherein said head includes means for receiving and supporting said body.

4. A golf club according to claim 3 wherein said head receiving and supporting means includes a notch in said head, said notch forming a ledge which supports said body.

5. A golf club according to claim 1 wherein the hardness of the body is 6.5–7.0 on Mohr's scale.

6. A golf club according to claim 1 wherein the lower edge of said body is spaced from the lower edge of said head.

7. A golf club according to claim 1 wherein the head is comprised of a unitary material.

8. In a golf club having an enlarged head for striking a golf ball, said head having a surface designed to contact said ball when the club is properly employed, the improvement comprising:

said head including a main portion and a body portion, said body portion being embedded in said main portion, said body portion being of greater hardness than the main portion, said body including an upper and a lower face and three substantially rectangular faces connecting complementary edges of said upper and lower faces, one of said rectangular faces comprising a portion of said contact surface, said upper and lower faces being of greater width at said contact surface and reducing in width as the distance from the contact surface increases.

9. A golf club according to claim 8 wherein said upper and said lower faces are substantially parallel.

10. A golf club according to claim 8 wherein said body is a semi-precious stone.

11. A golf club according to claim 8 wherein the hardness of the body is 6.5–7.0 on Mohr's scale.

12. A golf club according to claim 8 wherein the head portion is comprised of a unitary material.

13. A golf club according to claim 8 wherein said upper and lower faces are substantially triangular.

* * * * *